US005713380A

United States Patent [19]

Dietze

[11] Patent Number: 5,713,380

[45] Date of Patent: Feb. 3, 1998

[54] HAIR CURLER

[75] Inventor: Ruthard Dietze, Helmstedt, Germany

[73] Assignee: Solida Textil-Und Netzwarenmanufaktur GmbH & Co. KG, Helmstedt, Germany

[21] Appl. No.: 786,755

[22] Filed: Jan. 24, 1997

[30] Foreign Application Priority Data

Jan. 26, 1996 [DE] Germany ..... 196 02 660.1

[51] Int. Cl.[6] ..... A45D 2/14

[52] U.S. Cl. ..... 132/262; 132/245; 132/268; 132/226

[58] Field of Search ..... 132/250, 262, 132/245, 246, 260, 268, 226; 219/222, 225

[56] References Cited

U.S. PATENT DOCUMENTS

| | | | |
|---|---|---|---|
| 2,888,937 | 6/1959 | Weldon | 132/226 |
| 2,954,788 | 10/1960 | Madore | 132/262 |
| 3,123,080 | 3/1964 | Brenn-albertoni | 132/262 |
| 4,317,461 | 3/1982 | Anderson | 132/226 |
| 4,548,218 | 10/1985 | Glucksman | 132/226 |
| 4,881,559 | 11/1989 | Kin | 132/226 |

*Primary Examiner*—John J. Wilson
*Assistant Examiner*—Pedro Philogene
*Attorney, Agent, or Firm*—Salter & Michaelson

[57] ABSTRACT

In a hair curler with a cylindrical core having a tape made of plastics wire wound around it and with bands with loop-like barbs running around it, the core also has at least one metal, metal-coated, metallized carbon or antistatic filament arranged as a shield over its surface, or the cylindrical core is made of antistatic material, so that an antistatic effect is produced over its entire peripheral surface.

10 Claims, 1 Drawing Sheet

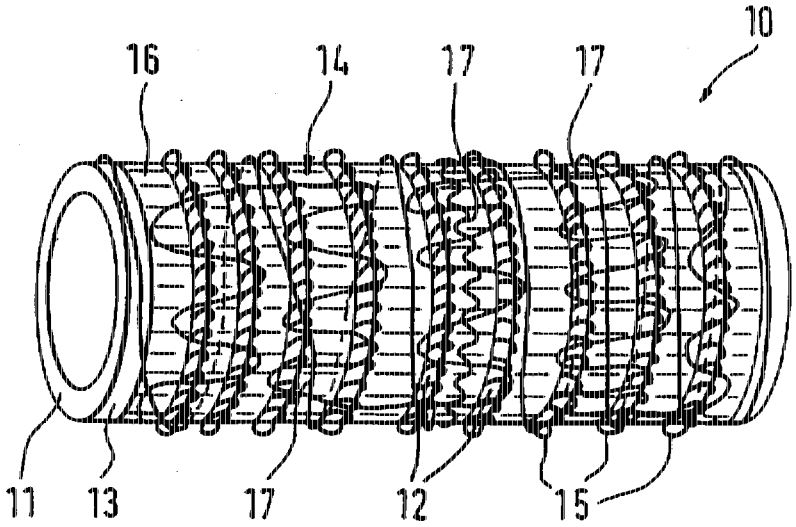
10
16
14
17
17
11
13
17
12
15

HAIR CURLER

BACKGROUND OF THE INVENTION

The invention relates to a hair curler with a cylindrical core with a tape made of plastics wire wound around it, which has mutually-spaced bands with loop-like barbs running around it.

Such curlers are known, for example curlers which have a hollow cylindrical core with so-called Velcro tape wound around it, which has mutually-spaced bands with loop-like barbs running around it. The cylindrical core of this known type of curler is made of plastics material and the Velcro tape is made of woven perlon or nylon wire. Individual loops are respectively drawn out from this band, and as a result barbs are formed which create the intended effect in the case of a self-holding curler. The effect of the barbs is to hold the clasped hair in place without any additional devices on the curler. The cylindrical core can be constructed as a hollow cylinder or alternatively as a foam-filled cylinder.

However, a problem frequently associated with such a curler is that it becomes statically charged during use. This causes unpleasant sensations for those using these curlers, such as pulling and tearing out individual hairs or clumps of hair, during removal of the curlers as a result of the static adhesion forces. Moreover, friction when putting in the curlers also causes hair which is not supposed to be included to be drawn in, and unintentionally, and very irritatingly, rolled in the curler.

SUMMARY OF THE INVENTION

The object of the present invention is therefore to provide a curler which greatly reduces these irritating effects using simple means.

This object is achieved according to the invention in that on its peripheral surface, the cylindrical core has the tape and at least one metal, metal-coated, metallised carbon or antistatic filament arranged as a shield over the surface, or in that the cylindrical core is made of antistatic material, so that an antistatic effect is produced over the entire peripheral surface of the core.

BRIEF DESCRIPTION OF THE DRAWING

An embodiment of the present invention will now be explained, by way of example only, with reference to the accompanying drawing, of which FIG. 1 is a sketched, perspective view of an antistatic hair curler according to the invention.

DESCRIPTION OF THE PREFERRED EMBODIMENT

Basically, according to the present invention, there is provided a hair curler with a cylindrical core having a peripheral surface with a tape made of plastics wire wound around it, said tape having mutually-spaced bands with loop-like barbs running around it, wherein, on its peripheral surface, said cylindrical core has both the tape and at least one metal, metal-coated, metallised carbon or antistatic filament arranged as a shield over said surface, or said cylindrical core is made of antistatic material, so that an antistatic effect is produced over the entire peripheral surface of said core.

It has surprisingly been established that such a filament can not only be applied to such a curler, but that it is additionally able to produce an antistatic effect and clearly reduce, and indeed even eliminate, the inconvenient and irritating effects of known curlers.

Previous static forces of attraction were substantially subject to chance and are heavily influenced by weather conditions or actions and movements made immediately beforehand, and were therefore difficult or impossible to take into consideration by the user. The measures according to the invention result in a curler which is virtually unchanged outwardly, but does not have any of these irritating effects and only exerts the adhesion forces applied and easily controlled by the barbs. This makes the curlers substantially more pleasant to use.

Another alternative is that the core to be covered is itself made of an antistatic material. For example, an appropriate filament can be fused into it or incorporated by another method during the production process.

It may be advantageously provided that the metallic, metal-coated, metallised or carbon filament or filaments are arranged to penetrate through the tape. This method of attachment results in a particularly hard-wearing bond of tape and plastics filaments.

It is particularly preferred if the filament or filaments are woven into the fabric surrounding the cylindrical core in the form of weft or warp threads.

This results in a particularly even distribution of the filaments and the effects achieved by them, and the antistatic effect can thus be assured particularly reliably. At the same time, production of this form is also particularly straightforward since the filament merely takes the place of specific threads to be woven in any case.

In a particular embodiment of the invention, it may be provided that the tape is a fabric disposed on the periphery of the cylindrical core so as to be waterproof and wash-fast. In this embodiment, several filaments may also be woven into the fabric of the tape in a simple manner in one process during the production process. As a result, a very hard-wearing bond of the filaments with the tape is assured, whereby the latter is firmly disposed on the core, and thus contributes to a long service life of a curler. This weaving in does not cause any aesthetic impairments.

Moreover, it can be advantageously provided that the plastics filament is made of nylon and is coated with a silver coating. Although most known plastics are well suited as material for filaments, nylon is generally particularly pliable in comparison with these, and is therefore the best suited.

Moreover, it can be advantageously provided that the metal coating on the plastics filament is joined to this so as to be waterproof and wash-fast. This ensures that the antistatic effect does not diminish even in a longer period of use. This can be achieved, for example, by vacuum metallisation or foaming of the metal coating.

Polypropylene has proved particularly advantageous as material for the fabric of the tape. Polypropylene is particularly easy to wash and, for example, does not absorb hair colouring agent, or even grease and dirt residues in the hair, but allows them to be easily removed. There have previously been considerable reservations concerning polypropylene in association with hair curlers, since it has a particularly disagreeable static effect, which additionally reinforces the usual irritating characteristics of hair curlers. However, as a result of the arrangement according to the invention, it is now possible to make use of the advantages of polypropylene (washable) without having to accept the disadvantages, since these are removed by the additional filaments.

However, a further advantage can be to produce the cylindrical tape from plastics wire made of perlon or nylon. An adequate antistatic effect has also been established in this case, which in particular permits refitting of curlers which frequently have tapes made of perlon. When refitting curlers, the metallic, metal coated, metallised or carbon filaments are frequently wound around the cylindrical cores subsequently, that is either in a spiral shape or staggered by several windings.

In a further preferred embodiment of the invention, it may be provided that the individual, drawn-out loop-like barbs are cut open. As a result of this, the adhesion of the barbs can be increased substantially in a simple manner.

Referring now to the drawing, FIG. 1 is a sketched perspective view showing a hair curler 10 according to the invention with a cylindrical core 11, which may also have perforations (not shown) in its peripheral surface 13. At a distance from the ends of the core 11, the peripheral surface 13 of the cylindrical core 11 has a tape 14 wound around it which has mutually-spaced bands 12 running around it, from which loop-like barbs 15 protrude essentially in radial direction. These barbs 15 provide the effect usually intended in hair curlers 10. The cylindrical core 11 is preferably made of plastics material and is constructed as a hollow cylinder.

Although this is not further shown in FIG. 1, the tape 14 is a wire made of perlon, from which the barbs 15 drawn out from this are also made. The tape 14 is disposed on the cylindrical core 11 so as to be waterproof and wash-fast, e.g. is glued or welded thereto.

A filament 17, only indicated by way of example, which is woven into the tape 14 and in the form of a silver-coated plastics filament in this case, is also clearly evident approximately in the centre of FIG. 1. This type of woven-in attachment is particularly strong and assures a long service life of the curler 10, and does not cause any aesthetic impairment.

However, it is also possible to arrange one or more silver-coated plastics filaments 17 above the tape 14 or on it in a spiral shape, as is indicated in axial direction of the core 11. Moreover, it is possible to also place the silver-coated plastics filament or filaments 17 on the tape 14 in a random or disordered manner, whereby all sections of the surface of the tape 14 must be included, as far as possible. This is indicated by way of example with the plastics filament 17 arranged in an undulating line in FIG. 1. The two first-mentioned alternatives have the advantage that existing curlers 10 which become statically charged, can be antistatically retrofitted, as it were, as a result of which they then have an antistatic effect. The plastics filament 17 respectively disposed on the tape 14 is held by hooking onto the barbs 15, as is the hair wound around the curler. A further possibility for fastening the silver-coated plastics filaments 17 can be assured by any type of perforation of the tape 14. However, this is not shown in FIG. 1.

The plastics filaments 17 are advantageously made of nylon, since this material is particularly pliable and the filaments 17 can therefore be easily woven in. However, other plastics material is equally suitable for the plastics filaments. The silver coating (not shown) au a plastics filament 17 is applied thereto so as to be waterproof and wash-fast. This can be achieved, for example, by vacuum metallisation.

As tests have shown, an antistatic effect is produced in existing, non-antistatic curlers 10 with tapes 14 made of perlon, for example, by the application of silver-coated plastics filaments 17 according to the invention.

Although this is not shown in FIG. 1, it can be advantageous for the adhesive power of the loop-like barbs 15 if these are cut open.

Since the silver-coated plastics filaments 17 are selected to be very thin, no aesthetic impairment whatsoever results from these regardless of how the plastics filament 17 is attached on or in the tape 14.

It will be understood that the above description of the present invention is susceptible to various modifications, changes and adaptations.

I claim:

1. A hair curler with a cylindrical core having a peripheral surface with a tape made of plastics wire wound around the tape, said tape having mutually-spaced bands with loop-shaped barbs running around the tape, wherein, on its peripheral surface, said cylindrical core has both the tape and at least one metal, metal-coated, metallised carbon or antistatic filament arranged as a shield over said surface, or said cylindrical core is made of antistatic material, so that an antistatic effect is produced over the entire peripheral surface of said core.

2. A hair curler according to claim 1, wherein said filament is arranged to penetrate through the tape or is woven into said tape.

3. A hair curler according to claim 1, wherein said tape is a fabric disposed on the periphery of said cylindrical core so as to be waterproof and wash-fast.

4. A hair curler according to claim 1, wherein said filament is a metal-coated plastics filament.

5. A hair curler according to claim 4, wherein said filament is made of nylon and is coated with a silver coating.

6. A hair curler according to claim 4, wherein the metal coating is joined to said plastics filament so as to be waterproof and wash-fast.

7. A hair curler according to claim 1, wherein the cylindrically arranged tape is made of polypropylene.

8. A hair curler according to claim 1, wherein said tape is formed from plastics wire made of perlon.

9. A hair curler according to claim 1, wherein a plurality of filaments are woven into fabric surrounding the cylindrical core in the form of weft thread or warp thread.

10. A hair curler according to claim 1, having a plurality of individual, drawn-out loop-like barbs, said barbs being cut open.

* * * * *